US008888581B2

(12) United States Patent
Chan et al.

(10) Patent No.: US 8,888,581 B2
(45) **Date of Patent: *Nov. 18, 2014**

(54) GAMING SYSTEM AND A METHOD OF GAMING

(71) Applicant: Aristocrat Technologies Australia Pty Limited, North Ryde (AU)

(72) Inventors: Matthew Chan, Rosebery (AU); Colin Fong, Rosebery (AU); Edgar Pau, Rosebery (AU)

(73) Assignee: Aristocrat Technologies Australia Pty Ltd (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/866,555

(22) Filed: Apr. 19, 2013

(65) Prior Publication Data

US 2013/0237308 A1 Sep. 12, 2013

Related U.S. Application Data

(63) Continuation of application No. 11/855,834, filed on Sep. 14, 2007, now Pat. No. 8,444,478.

(30) Foreign Application Priority Data

Sep. 15, 2006 (AU) ..... 2006905103

(51) Int. Cl.
*G07F 17/32* (2006.01)

(52) U.S. Cl.
CPC ..... *G07F 17/3286* (2013.01); *G07F 17/32* (2013.01); *G07F 17/3267* (2013.01)
USPC ..... 463/20; 463/22; 463/23

(58) Field of Classification Search
USPC ..... 463/20, 22, 23
See application file for complete search history.

(56) References Cited

U.S. PATENT DOCUMENTS

| | | | | |
|---|---|---|---|---|
| 6,796,903 | B1 | 9/2004 | Bryant | |
| 8,337,293 | B2 * | 12/2012 | Fong et al. | 463/20 |
| 2003/0148804 | A1 | 8/2003 | Ikeya et al. | |
| 2009/0221344 | A1 * | 9/2009 | Fong et al. | 463/20 |
| 2010/0222127 | A1 | 9/2010 | Finch | |
| 2011/0275429 | A1 * | 11/2011 | Chim | 463/17 |

FOREIGN PATENT DOCUMENTS

WO 03043710 A1 5/2003

* cited by examiner

*Primary Examiner* — Pierre E Elisca
(74) *Attorney, Agent, or Firm* — McAndrews, Held & Malloy, Ltd.

(57) ABSTRACT

A gaming system is disclosed which comprises a symbol selector arranged to select at least one player symbol at each level of a multilevel game from a set of symbols, an outcome generator arranged to determine at each level of the multilevel game a successful or unsuccessful game level outcome based on a comparison of the at least one selected player symbol with at least one reference symbol such that the player proceeds to a succeeding game level if the game outcome is successful and the player does not proceed to a succeeding game level if the game outcome is not successful. The gaming system also comprises a prize allocator arranged to allocate a prize to a player based on the game level the player has successfully completed. A corresponding method is also disclosed.

20 Claims, 9 Drawing Sheets

GAMING SYSTEM AND A METHOD OF GAMING

RELATED APPLICATIONS

This application claims priority to, and is a continuation of, co-pending U.S. patent application Ser. No. 11/855,834 having a filing date of Sep. 14, 2007, and which claims priority of International Application No. AU2006905103, having a filing date of Sep. 15, 2006, which are hereby incorporated herein by reference in their entirety.

FIELD OF THE INVENTION

The present invention relates to a gaming system and to a method of gaming.

BACKGROUND OF THE INVENTION

It is known to provide a gaming system which comprises a game controller arranged to randomly display several symbols from a predetermined set of symbols and to determine a game outcome such as a game win based on the displayed symbols. Such gaming systems may commonly be implemented as a stepper machine provided with reels with each reel carrying several symbols of the set, or a video machine wherein selected symbols are displayed on a graphical display device. Win outcomes can occur based on the displayed symbols.

SUMMARY OF THE INVENTION

In accordance with a first aspect of the present invention, there is provided a gaming system comprising:

a symbol selector arranged to select at least one player symbol at each level of a multilevel game from a set of symbols;

an outcome generator arranged to determine at each level of the multilevel game a successful or unsuccessful game level outcome based on a comparison of the at least one selected player symbol with at least one reference symbol such that the player proceeds to a succeeding game level if the game outcome is successful and the player does not proceed to a succeeding game level if the game outcome is not successful; and a prize allocator arranged to allocate a prize to a player based on the game level the player has successfully completed.

In one arrangement, the at least one reference symbol is attributed to the gaming system. With this arrangement, the symbol selector may be arranged to select at least one reference symbol at each level of the multilevel game from the set of symbols.

In an alternative arrangement, the at least one reference symbol is attributed to a player. With this arrangement, the at least one reference symbol may be at least one symbol selected by the symbol selector and attributed to the player in a previous level of the multilevel game.

In one embodiment, the multilevel game is a multiplayer game. With this arrangement, the comparator may be arranged to compare the respective selected player symbols with each other or with at least one reference symbol attributed to the gaming system.

In one embodiment, the gaming system is arranged such that the probability of proceeding to a successive level tends to reduce with each successive level of the game.

In one embodiment, the comparator is arranged to compare one reference symbol with the or each selected player symbol, the outcome generator allows the player to proceed to a succeeding game level if the outcome generator determines that the game outcome associated with at least one player symbol is successful, and the symbol selector is arranged to select a number of player symbols at the succeeding game level which corresponds to the number of player symbols associated with successful game outcomes.

In one arrangement, the comparator is arranged to compare a highest or lowest ranked reference symbol with the or each selected player symbol. The reference symbols and the player symbols may comprise numbers, pictures or shapes and the comparator may be arranged to compare a highest or lowest ranked reference number, picture or shape with the or each selected player number, picture or shape.

In one arrangement, the reference symbols and the player symbols comprise numbers and the outcome generator determines a successful outcome if any one of the selected player symbols is ranked greater than, or greater than or equal to the highest or lowest ranked symbol of the selected reference symbols. In an alternative arrangement, the outcome generator determines a successful outcome if any one of the selected player symbols is ranked less than, or less than or equal to the highest or lowest ranked symbol of the selected reference symbol.

In one arrangement, the comparator is arranged to compare a selected reference symbol combination with a selected player symbol combination. The reference symbols and the player symbols may comprise numbers and the comparator may be arranged to compare a sum of the selected reference numbers with a sum of the selected player numbers.

In one arrangement, the outcome generator determines a successful outcome if the sum of the selected player numbers is greater than or equal to the sum of the selected reference numbers. In an alternative arrangement, the outcome generator determines a successful outcome if the sum of the selected player numbers is less than, or less than or equal to the sum of the selected reference numbers.

The gaming system may be arranged to apply a linear ranking to the symbols, or may be arranged to apply a circular ranking to the symbols, such as in the game "scissors, paper, rock".

In one embodiment, the symbols comprise representations of dice, cards, dominos, tiles or shapes.

The symbols may comprise at least one function symbol. The function associated with a function symbol may be a wild function.

The set of symbols may be fixed for all levels of the multilevel game or the set of symbols from which the player symbols and the reference symbols are selected may be dependent on the game level.

In one arrangement, the number of selected reference symbols is fixed for all levels of the multilevel game. In an alternative arrangement, the number of selected reference symbols increases or decreases with each succeeding level of the multilevel game.

In one embodiment, the prize allocator is arranged to additionally allocate a prize to a player based on occurrence of a predetermined combination of player symbols at a level of the multilevel game, or based on occurrence of a predetermined sequence of symbol combinations in consecutive levels of the multilevel game.

The gaming system may be arranged such that a player is able to choose to continue in the multilevel game and thereby risk losing a prize or a portion of a prize associated with a level successfully reached, or to end the game and receive a prize applicable to the level of the game reached by the player.

The or each prize may be in the form of a monetary amount, points, tokens, progressive prizes, eligibility for feature games, tournament entitlements, or entitlements to inclusion of special symbols in one or more levels of the game, such as function symbols.

The gaming system may be implemented as a stand alone gaming machine or across a network.

In accordance with a second aspect of the present invention, there is provided a method of gaming comprising:

selecting at least one player symbol at each level of a multilevel game from a set of symbols;

comparing the at least one selected player symbol with at least one reference symbol at each level of the multilevel game;

determining a successful or unsuccessful game level outcome based on the comparison such that the player proceeds to a succeeding game level if the game outcome is successful and the player does not proceed to a succeeding game level if the game outcome is not successful; and allocating a prize to a player based on the game level reached by the player.

In accordance with a third aspect of the present invention, there is provided a computer program arranged when loaded into a computer to instruct the computer to operate in accordance with a gaming system comprising:

a symbol selector arranged to select at least one player symbol at each level of a multilevel game from a set of symbols;

a comparator arranged to compare the at least one selected player symbol with at least one reference symbol at each level of the multilevel game;

an outcome generator arranged to determine a successful or unsuccessful game level outcome based on the comparison such that the player proceeds to a succeeding game level if the game outcome is successful and the player does not proceed to a succeeding game level if the game outcome is not successful; and a prize allocator arranged to allocate a prize to a player based on the game level reached by the player.

In accordance with a forth aspect of the present invention, there is provided a computer readable medium having computer readable program code embodied therein for causing a computer to operate in accordance with a gaming system comprising:

a symbol selector arranged to select at least one player symbol at each level of a multilevel game from a set of symbols;

a comparator arranged to compare the at least one selected player symbol with at least one reference symbol at each level of the multilevel game;

an outcome generator arranged to determine a successful or unsuccessful game level outcome based on the comparison such that the player proceeds to a succeeding game level if the game outcome is successful and the player does not proceed to a succeeding game level if the game outcome is not successful; and a prize allocator arranged to allocate a prize to a player based on the game level reached by the player.

BRIEF DESCRIPTION OF THE DRAWINGS

The present invention will now be described, by way of example only, with reference to the accompanying drawings, in which.

DESCRIPTION OF AN EMBODIMENT OF THE INVENTION

Figure 1:
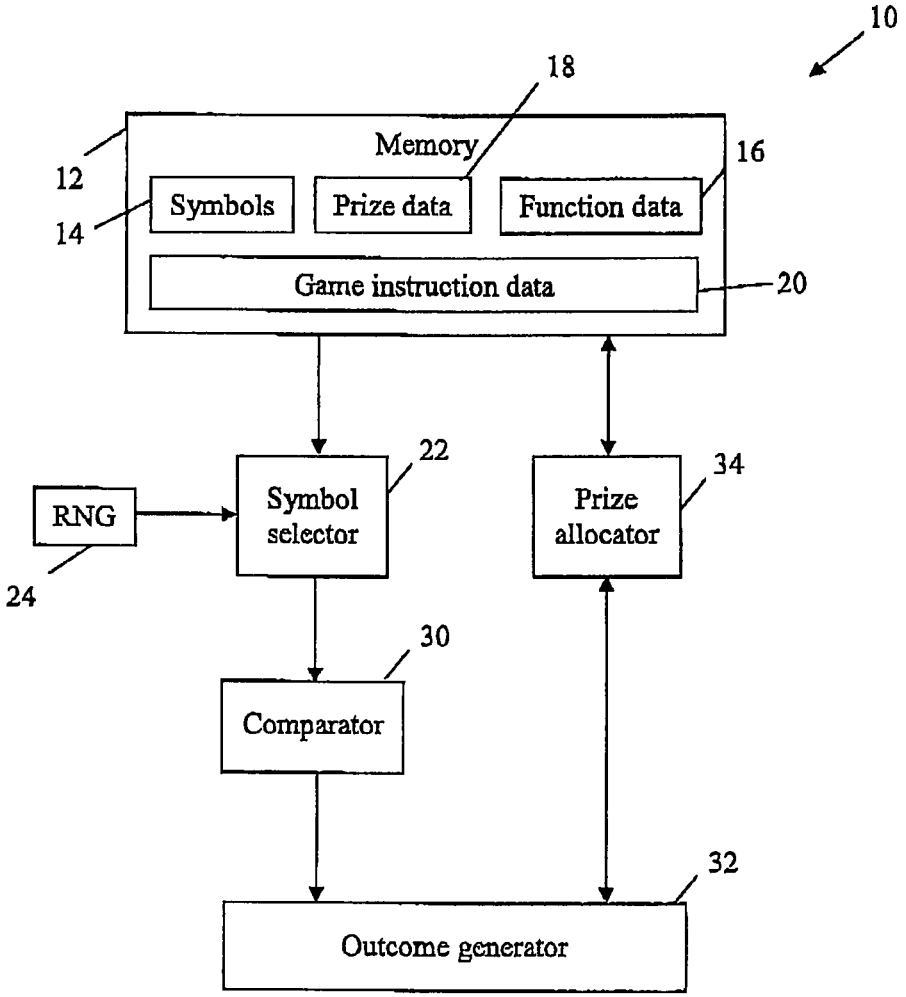
FIG. 1 is a diagrammatic block diagram of a gaming system in accordance with an embodiment of the present invention.

Referring to the drawings, there is shown a gaming system arranged to implement a multilevel probabilistic wagering game wherein a player wagers a bet amount and a prize is allocated to the player depending on the game level reached by the player. For example, the prize amount may increase with each succeeding level from an initial amount applicable for reaching a first level. The initial amount may be zero.

The multilevel game implemented by the gaming system operates such that for each level of the game a reference symbol or combination of reference symbols is compared with a player symbol or combination of player symbols in accordance with predefined rules in order to determine whether the player is successful or unsuccessful. Success as defined by the rules enables the player to pass to the next level. Failure causes the multilevel game to cease and for a prize associated with the level successfully reached by the player to be allocated to the player.

The symbols may take any suitable form such as representations of dice, cards, dominoes, tiles, shapes or any other type of symbols which have an associated ranking or to which a ranking can be applied so that a comparison of the reference symbol(s) with the player symbol(s) yields a success or failure result. The ranking may be fixed or may vary according to a schedule, such as in the game "scissors, paper, rock".

In one example, the symbols are representations of dice numbers and success is determined on the basis of whether any of the players dice show a number greater than or equal to the highest number shown on the reference dice.

In an alternative example, the symbols are representations of dice numbers and success is determined on the basis of whether the sum of the numbers shown on the players dice is greater than or equal to the sum of the numbers shown on the reference dice.

The dice may be of the type including numbers, letters, one or more colours, or at least one special symbol or colour having an allocated special function or prize.

The number of player and/or reference dice may be constant or may vary according to game rules, for example may increase or decrease with each succeeding game level, and the dice used may comprise the same symbols or may have different combinations of symbols. Each level of the multilevel game may use the same dice or may use different dice depending on the level.

The reference symbol or combination of symbols may be attributed to the gaming system, for example in an embodiment wherein the symbols are representations of dice numbers, by referring to the reference symbol(s) as a "dealer throw", or may be the previous symbol or combination of symbols attributed to the player and referred to as a previous "player throw".

The symbols may include standard symbols and may additionally include one or more function symbols, and the ranking associated with a symbol or combination of symbols may be determined on the basis of the displayed standard symbols and the function associated with any displayed function symbol. The function associated with a function symbol may be for example a wild function wherein display of the function symbol is treated during consideration of the game outcome as any of the standard symbols or as a predetermined function selected by the gaming system on commencement of the multilevel game.

Referring to FIG. 1, a gaming system 10 for implementing a multilevel game is shown in diagrammatic form. The gaming system 10 comprises a memory 12 arranged to store symbols data 14 indicative of a plurality of symbols for selection and display to a player during a game, function data 16 indicative of one or more functions associated with one or more of the symbols, prize data 18 indicative of prize amounts associated with win outcomes for reaching each level of the game, and game instruction data 20 indicative of game instructions usable by the gaming machine 10 to control operation of the multilevel game.

The gaming system 10 also includes a symbol selector 22 which is arranged to select one or more symbols for display to a player as one or more reference symbols, and to select one or more symbols for display to the player as one or more player symbols, in this example using a random number generator 24.

It will be appreciated that the random number generator 24 may be of a type which is arranged to generate pseudo random numbers based on a seed number, and that in this specification the term "random" will be understood accordingly to mean truly random or pseudo random.

The gaming system 10 also comprises a comparator 30 arranged to compare the reference symbol(s) with the player symbol(s) in accordance with the game instruction data 20, and an outcome generator 32 which in accordance with the game instruction data 20 determines whether the player is successful and therefore able to pass to the next level of the multilevel game or unsuccessful and therefore not able to pass to the next level of the game.

While in this example the comparator and the outcome generator are shown as separate components, it will be understood that the functions of the outcome generator and the comparator may be implemented by one component.

The gaming system 10 also comprises a prize allocator 34 which communicates with the prize data 18 stored in the memory 12 and with the outcome generator 30, and determines an appropriate prize to allocate to a player depending on which level of the game the player has reached.

Additional prizes may be allocated on the basis of occurrence of a predetermined combination, such as for example the same symbol on all dice, a consecutive sequence such as 1,2,3, occurrence of all odd or all even numbers, occurrence of the same symbol combination, a predetermined sequence in consecutive throws, and so on. The additional prizes may take the form of one or more additional throws.

The gaming system 10 may also be arranged such that a player has the option of choosing to continue in the multilevel game and thereby attempt to reach a succeeding level, or to end the game and receive the prize amount applicable for the current level reached by the player.

Instead of providing monetary prize amounts, the prize allocated to a player for reaching a level and/or any additional prize may be in the form of points, tokens, progressive prizes, eligibility for feature games, tournament entitlements, or special symbol entitlements in other games, such as an additional wild symbol for a predetermined number of games.

The multilevel game may be implemented as part of another game wherein the multilevel game is activated as a result of any predetermined action, such as a game outcome related event, an operator initiated event, a random event, an event related to turnover, or an event related to special bets being placed.

In the embodiment described below, the symbol selector 22, the comparator 30, the prize allocator 34 and the outcome generator 30 are implemented using a microprocessor and associated programs, although it will be understood that other implementations are envisaged.

The gaming system 10 can take a number of different forms.

In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 2:
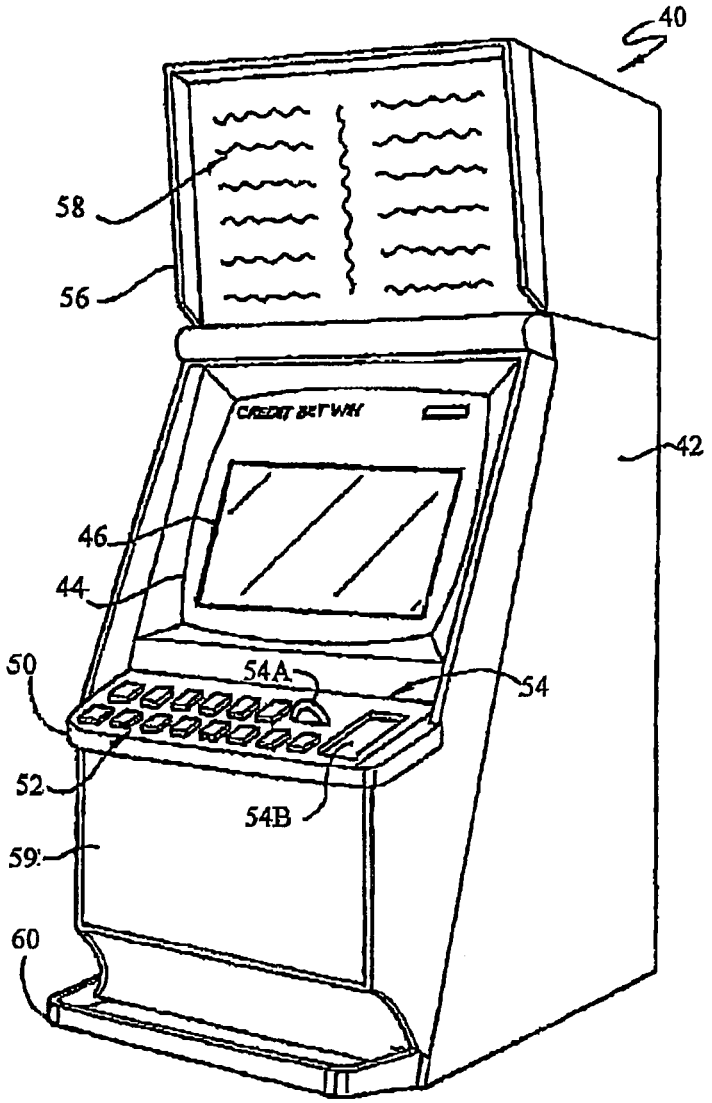
FIG. 2 is a diagrammatic representation of a gaming system in accordance with an embodiment of the present invention with the gaming system implemented in the form of a stand alone gaming machine.

A gaming system in the form of a stand alone gaming machine 40 is illustrated in FIG. 2. The gaming machine 40 includes a console 42 having a display 44 on which is displayed representations of a game 46 that can be played by a player. A mid-trim 50 of the gaming machine 40 houses a bank of buttons 52 for enabling a player to interact with the gaming machine during gameplay, including enabling the player to select the bet amount and the number of lines. The mid-trim 50 also houses a credit input mechanism 54 which in this example includes a coin input chute 54A and a bill collector 54B. Other credit input mechanisms may also be employed, for example, a card reader for reading a smart card, debit card or credit card. A reading device may also be provided for the purpose of reading a player tracking device, for example as part of a loyalty program. The player tracking device may be in the form of a card, flash drive or any other portable storage medium capable of being read by the reading device.

A top box 56 may carry artwork 58, including for example pay tables and details of bonus awards and other information or images relating to the game. Further artwork and/or information may be provided on a front panel 59 of the console 42. A coin tray 60 is mounted beneath the front panel 59 for dispensing cash payouts from the gaming machine 30.

The display 44 is in the form of a video display unit, particularly a cathode ray tube screen device. Alternatively, the display 44 may be a liquid crystal display, plasma screen, any other suitable video display unit. The top box 56 may also include a display, for example a video display unit, which may be of the same type as the display 44, or of a different type.

The display 44 in this example is arranged to display representations of several reels, each reel of which has several associated symbols. Typically 3, 4 or 5 reels are provided.

Figure 3:
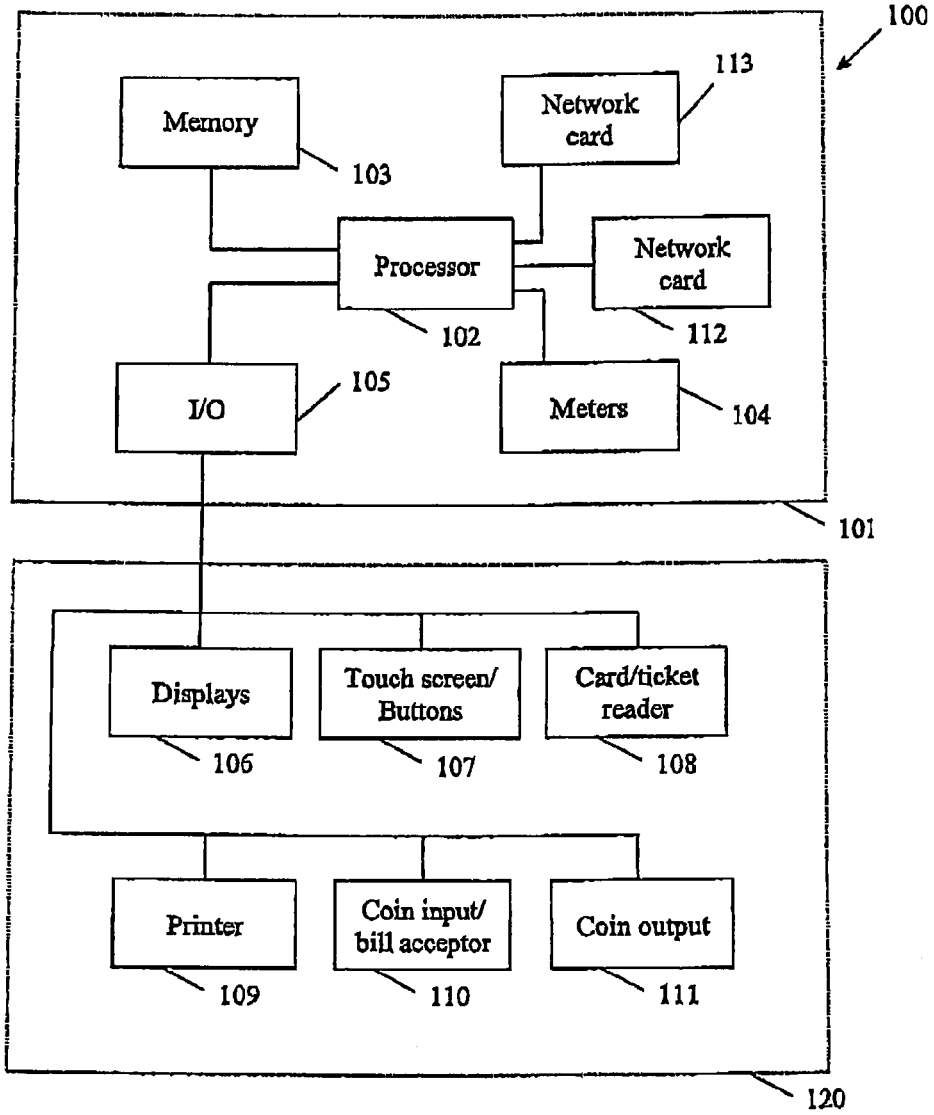
FIG. 3 is a schematic block diagram of operative components of the gaming machine shown in FIG. 2.

FIG. 3 shows a block diagram of operative components of a typical gaming machine 100 which may be the same as or different to the gaming machine shown in FIG. 2.

The gaming machine 100 includes a game controller 101 having a processor 102. Instructions and data to control operation of the processor 102 in accordance with the present invention are stored in a memory 103 which is in data communication with the processor 102.

Typically, the gaming machine 100 will include both volatile and non-volatile memory and more than one of each type of memory, with such memories being collectively represented by the memory 103.

Figure 4:
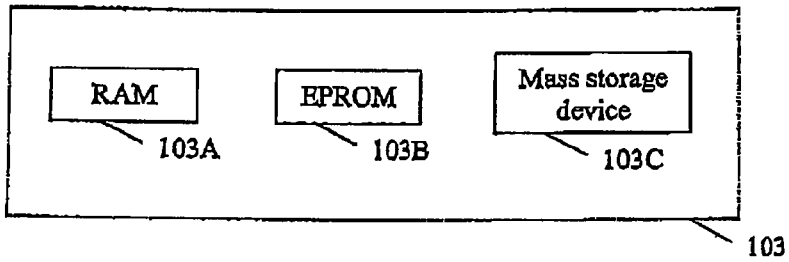
FIG. 4 is a schematic block diagram of components of a memory of the gaming machine shown in FIG. 2.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere, and data indicative of symbols, prize amounts and symbol functions used in the game.

The gaming machine has hardware meters 104 for purposes including ensuring regulatory compliance and monitoring player credit, an input/output (I/O) interface 105 for communicating with a player interface 120 of the gaming machine 100, the player interface 120 having several peripheral devices. The input/output interface 105 and/or the peripheral devices may be intelligent devices with their own memory for storing associated instructions and data for use with the input/output interface or the peripheral devices. A random number generator module 113 generates random numbers for use by the processor 102.

In the example shown in FIG. 3, the peripheral devices that communicate with the game controller 101 comprise one or more displays 106, a touch screen and/or bank of buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

It is also possible for the operative components of the gaming machine 100 to be distributed, for example input/output devices 106,107,108,109,110,111 may be provided remotely from the game controller 101.

Figure 5:
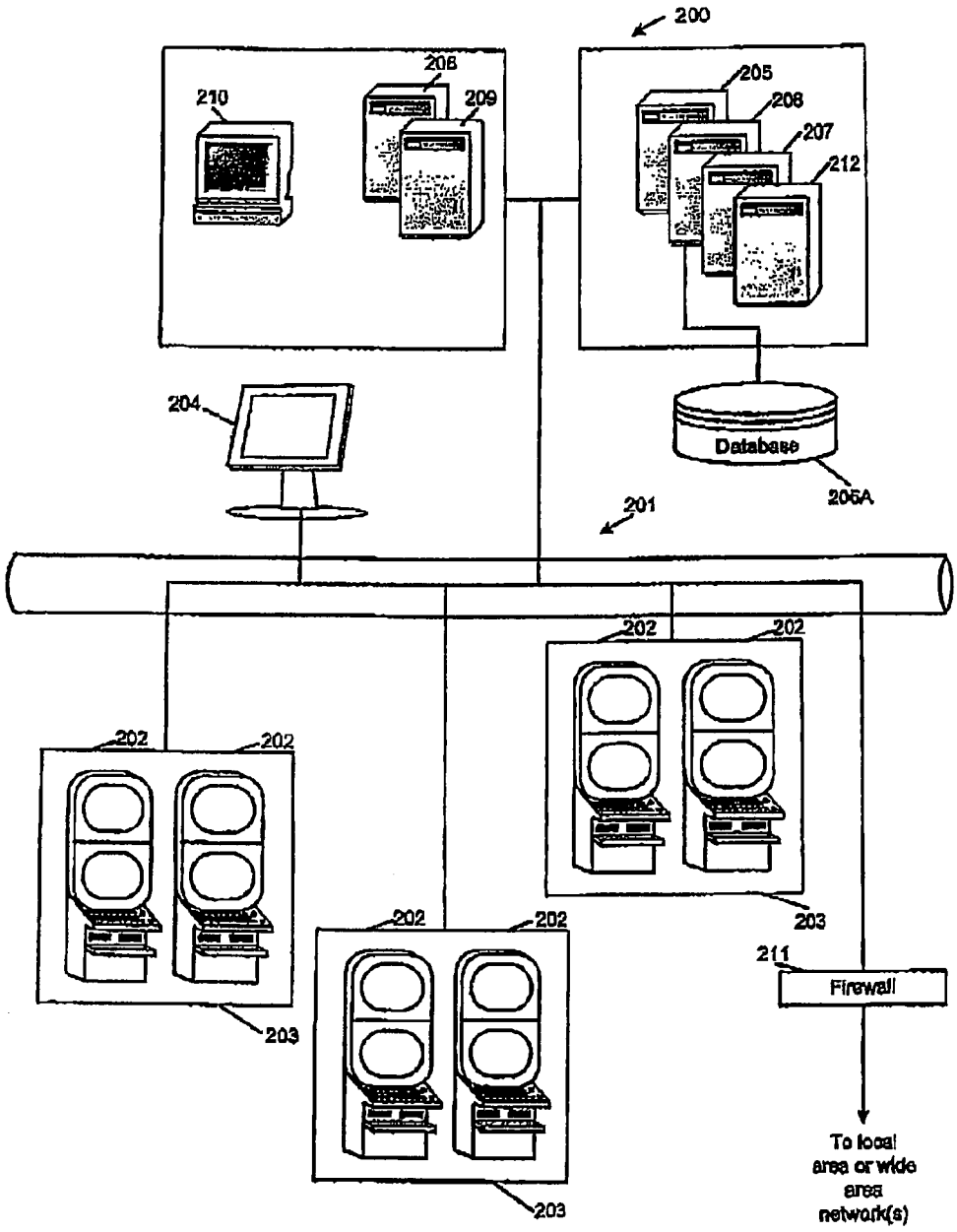
FIG. 5 is a schematic diagram of a gaming system in accordance with an alternative embodiment of the present invention with the gaming system implemented over a network.

FIG. 5 shows a gaming system 200 in accordance with an alternative embodiment. The gaming system 200 includes a network 201, which for example may be an Ethernet network, a LAN or a WAN. In this example, three banks 203 of two gaming machines 202 are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, a game server 205 implements part of the game played by a player using a gaming machine 202 and the gaming machine 202 implements part of the game. With this embodiment, as both the game server 205 and the gaming machine 202 implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game.

In a thin client embodiment, the game server 205 implements most or all of the game played by a player using a gaming machine 202 and the gaming machine 202 essentially provides only the player interface. With this embodiment, the game server 205 provides the game controller. The gaming machine will receive player instructions, and pass the instructions to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming system 200, including for example a gaming floor management server 208 and a licensing server 209 to monitor the use of licenses relating to particular games. An administrator terminal 210 is provided to allow an administrator to monitor the network 201 and the devices connected to the network.

The gaming system 200 may communicate with other gaming systems, other local networks such as a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random number generator engine. Alternatively, a separate random number generator server could be provided.

During operation, the game controller, whether implemented in a stand alone gaming machine 10, 100 or over a network 201, implements a probabilistic multilevel wagering game wherein a prize is allocated to a player based on the game level reached by the player, and a player moves to a succeeding level of the game based on a comparison between one or more reference symbols and one or more player symbols.

An example of a specific implementation of the gaming system will now be described in relation to a stand alone gaming machine 40, 100, although it will be understood that implementation may also be carried out using other gaming system architectures such as a network architecture of the type shown in FIG. 5.

In the present embodiment, the gaming system 10 is arranged to display virtual symbols using a video graphical display device, although it will be understood that other arrangements are envisaged, such as reels with the symbols disposed thereon. The symbols in this example are in the form of representations of dice numbers.

Figure 6:
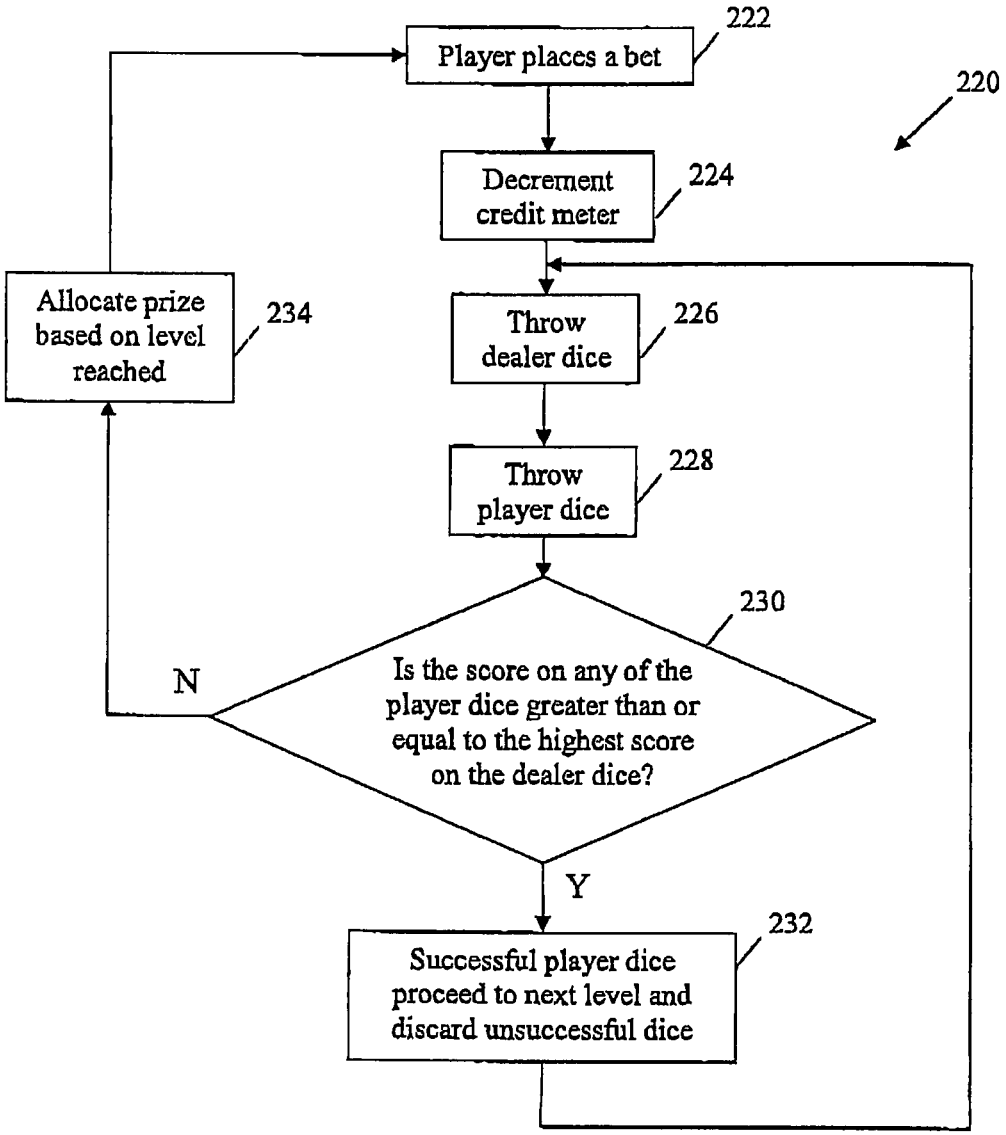
FIG. 6 is a flow diagram illustrating a method of gaming in accordance with an embodiment of the present invention.

Referring to FIG. 6, there is shown a flow diagram 220 which illustrates steps 222 to 234 of a method of gaming implemented by the gaming system 10.

In this example, the player can obtain up to 10 dice for use during the game by purchasing dice at a cost of 1 credit per die, either before or during a game. The player can also bet up to 5 credits on the outcome of the game, either before the game or during the game, with an increase in the bet placed having the effect of multiplying the possible prize amount allocatable for each level of the game.

With this example, the gaming system 10 implements a game wherein a player advances to a succeeding level of the game if the number shown on at least one of the players dice is greater than or equal to the highest number shown on the reference dice. The reference dice are hereinafter referred to in this example as "dealer dice".

In one particular example, the symbols on each of the dice are 1, 2, 3, 4, 5 and 6, 3 dice are allocated to the dealer and 10 dice are purchased by the player. The player and dealer dice may be represented in different colours.

Figure 7:
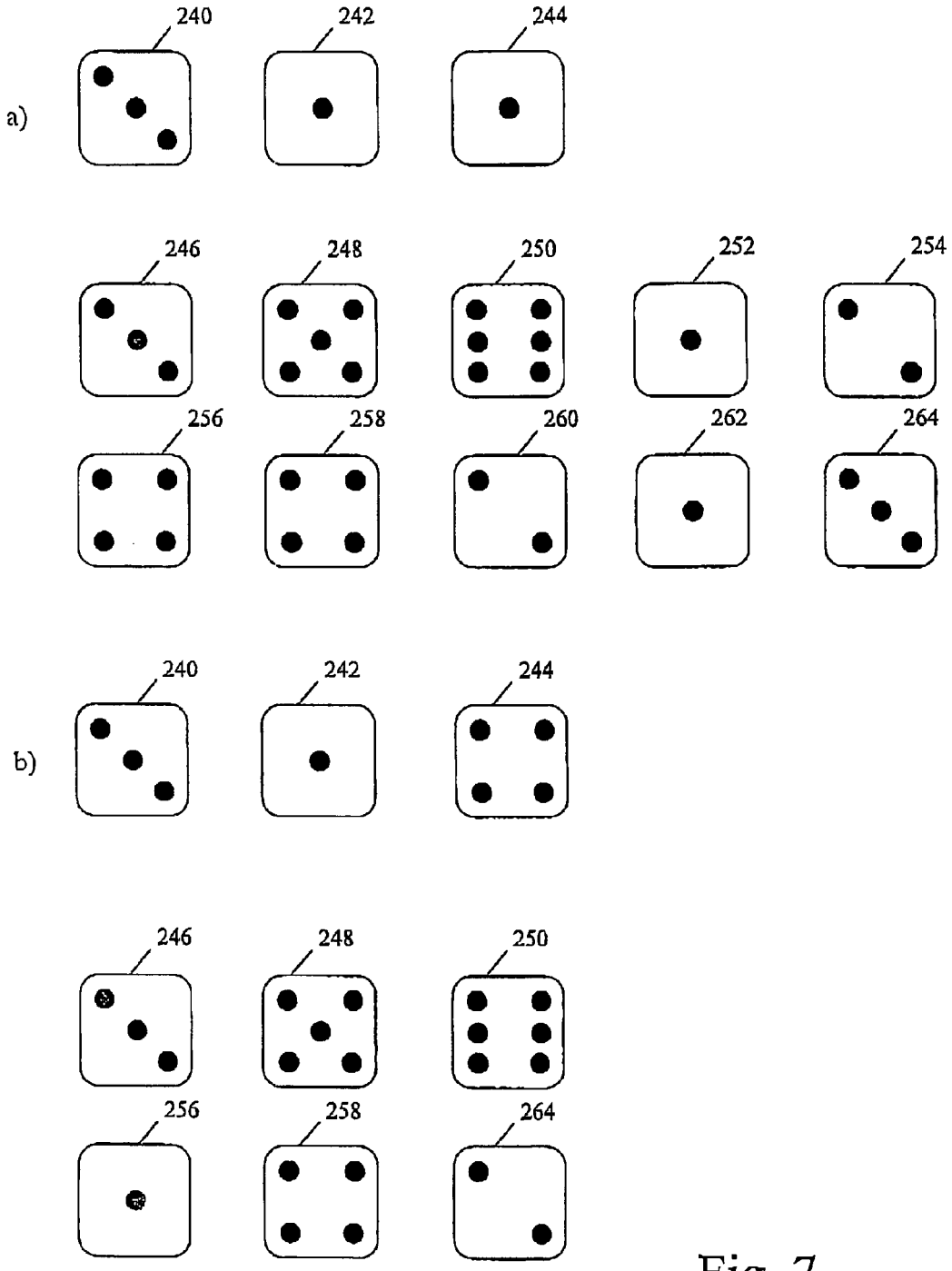
FIGS. 7*a* to 7*e* are diagrammatic representations of example symbols displayed by a gaming system in accordance with an embodiment of the present invention when implementing the method of gaming illustrated in FIG. 6.
Figure 7:
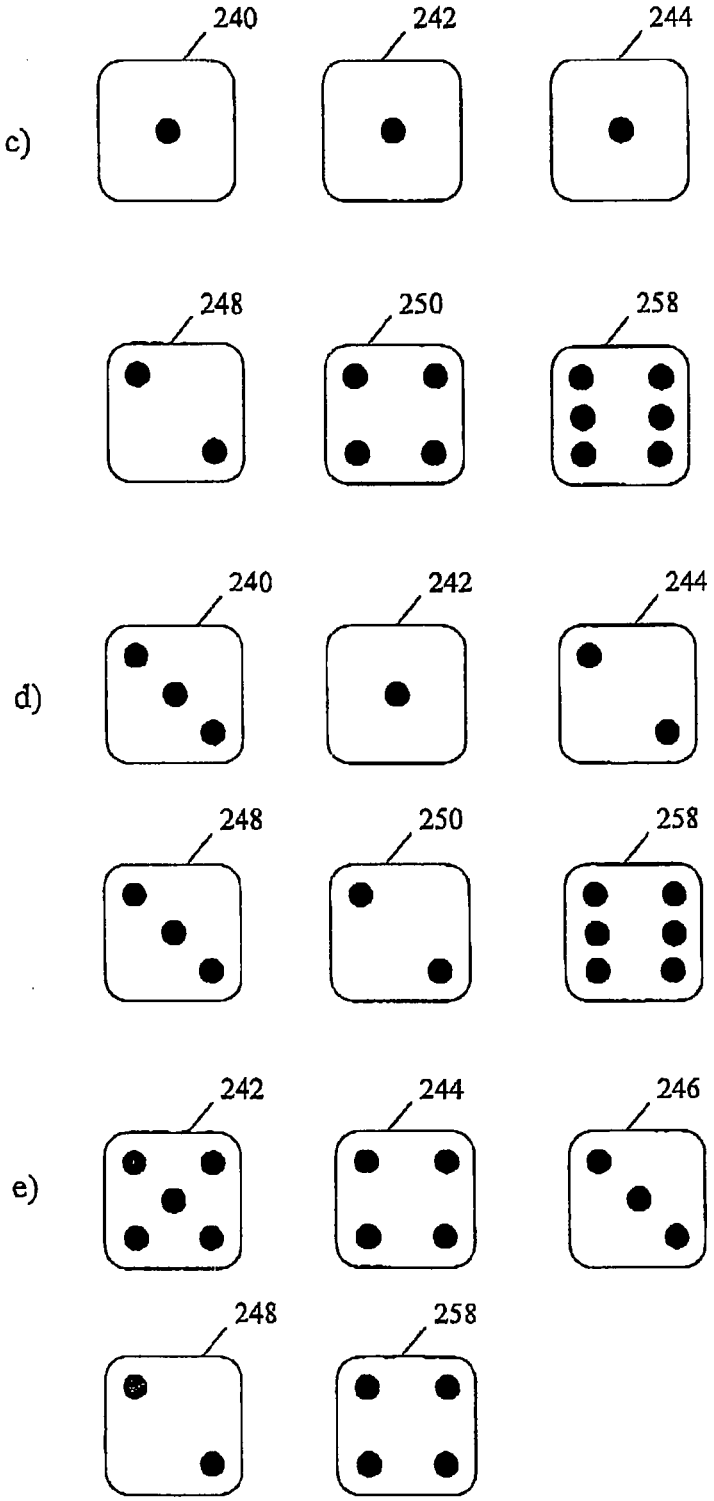

The symbol selector 22 first selects 3 numbers for the 3 respective dealer dice 240, 242 and 244, then selects 10 numbers for the 10 respective player dice 246, 248, 250, 252, 254, 256, 258, 260, 262, 264, as shown in FIG. 7*a*.

The comparator 30 compares the highest number on the dealer dice with the numbers on the player dice and if any of the numbers on the player dice are equal to or greater than the highest number on the dealer dice, those dice are retained and the player proceeds to the next level with the retained dice. If none of the numbers on the player dice are equal to or greater than the highest number on the dealer dice, the multilevel game ceases and the outcome generator 32, in association with the prize allocator 34 and the prize data 18, then allocates an appropriate prize to the player dependent on the amount bet and the prize amount associated with the first level.

In the present example, the highest number on the dealer dice is 3 and 6 player dice have a number greater than or equal to 3. Accordingly, 6 player dice proceed to the second level.

In this example, the number of dealer dice remains the same throughout the multilevel game, although it will be understood that other variations are possible. For example, the number of dealer dice may increase or decrease with each succeeding level.

At the second level, the symbol selector 22 selects 3 numbers for the 3 respective dealer dice 240, 242 and 244, then selects 6 numbers for the 6 remaining player dice 246, 248, 250, 256, 258, 264, as shown in FIG. 7*b*.

The comparator 30 compares the highest number on the dealer dice with the numbers on the player dice and if any of the numbers on the player dice are equal to or greater than the highest number on the dealer dice, those dice are retained and the player proceeds to the third level with the retained dice. If none of the numbers on the player dice are equal to or greater than the highest number on the dealer dice, the multilevel game ceases and the outcome generator 32, in association with the prize allocator 34 and the prize data 18, then allocates an appropriate prize to the player dependent on the amount bet and the prize amount associated with reaching the second level.

In the present example, the highest number on the dealer dice is 4 and 3 player dice 248, 250 and 258 have a number greater than or equal to 4. Accordingly, 3 player dice proceed to the third level.

At the third level, the symbol selector 22 selects 3 numbers for the 3 respective dealer dice 240, 242 and 244, then selects 3 numbers for the 3 remaining player dice 248, 250 and 258, as shown in FIG. 7*c*.

The comparator 30 compares the highest number on the dealer dice with the numbers on the player dice and if any of the numbers on the player dice are equal to or greater than the highest number on the dealer dice, those dice are retained and the player proceeds to the forth level with the retained dice. If none of the numbers on the player dice are equal to or greater than the highest number on the dealer dice, the multilevel game ceases and the outcome generator 32, in association with the prize allocator 34 and the prize data 18, then allocates an appropriate prize to the player dependent on the amount bet and the prize amount associated with reaching the third level.

In the present example, the highest number on the dealer dice is 1, and all 3 player dice 248, 250 and 258 have a number greater than or equal to 1. Accordingly, all 3 player dice proceed to the forth level.

At the fourth level, the symbol selector 22 selects 3 numbers for the 3 respective dealer dice 240, 242 and 244, then selects 3 numbers for the 3 remaining player dice 248, 250 and 258, as shown in FIG. 7*d*.

The comparator 30 compares the highest number on the dealer dice with the numbers on the player dice and if any of the numbers on the player dice are equal to or greater than the highest number on the dealer dice, those dice are retained and the player proceeds to the fifth level with the retained dice. If none of the numbers on the player dice are equal to or greater than the highest number on the dealer dice, the multilevel game ceases and the outcome generator 32, in association with the prize allocator 34 and the prize data 18, then allocates an appropriate prize to the player dependent on the amount bet and the prize amount associated with reaching the forth level.

In the present example, the highest number on the dealer dice is 3, and 2 player dice 248 and 258 have a number greater than or equal to 3. Accordingly, 2 player dice proceed to the fifth level.

At the fifth level, the symbol selector 22 selects 3 numbers for the 3 respective dealer dice 240, 242 and 244, then selects 2 numbers for the 2 remaining player dice 248 and 258, as shown in FIG. 7*e*.

The comparator 30 compares the highest number on the dealer dice with the numbers on the player dice and if any of the numbers on the player dice are equal to or greater than the highest number on the dealer dice, those dice are retained and the player proceeds to the sixth level with the retained dice. If none of the numbers on the player dice are equal to or greater than the highest number on the dealer dice, the multilevel game ceases and the outcome generator 32, in association with the prize allocator 34 and the prize data 18, then allocates an appropriate prize to the player dependent on the amount bet and the prize amount associated with reaching the fifth level.

In the present example, the highest number on the dealer dice is 5, and none of the player dice 248 and 258 have a number greater than or equal to 5. Accordingly, none of the player dice proceed to the sixth level.

The outcome generator 32, in association with the prize allocator 34 and the prize data 18 then allocates an appropriate prize to the player dependent on the amount bet and the prize amount associated with reaching the fifth level.

While the present embodiment is described in relation to a game wherein a player proceeds to a succeeding level if at least one of the numbers on the players dice is greater than or equal to the highest number shown on the reference dice, it will be understood that other arrangements are envisaged. For example, the game may be implemented such that a player proceeds to a succeeding level if at least one number on the players dice is equal to the highest or lowest number shown on the reference dice, less than or equal to the lowest number on the reference dice, or less than the lowest number on the reference dice.

Figure 8:
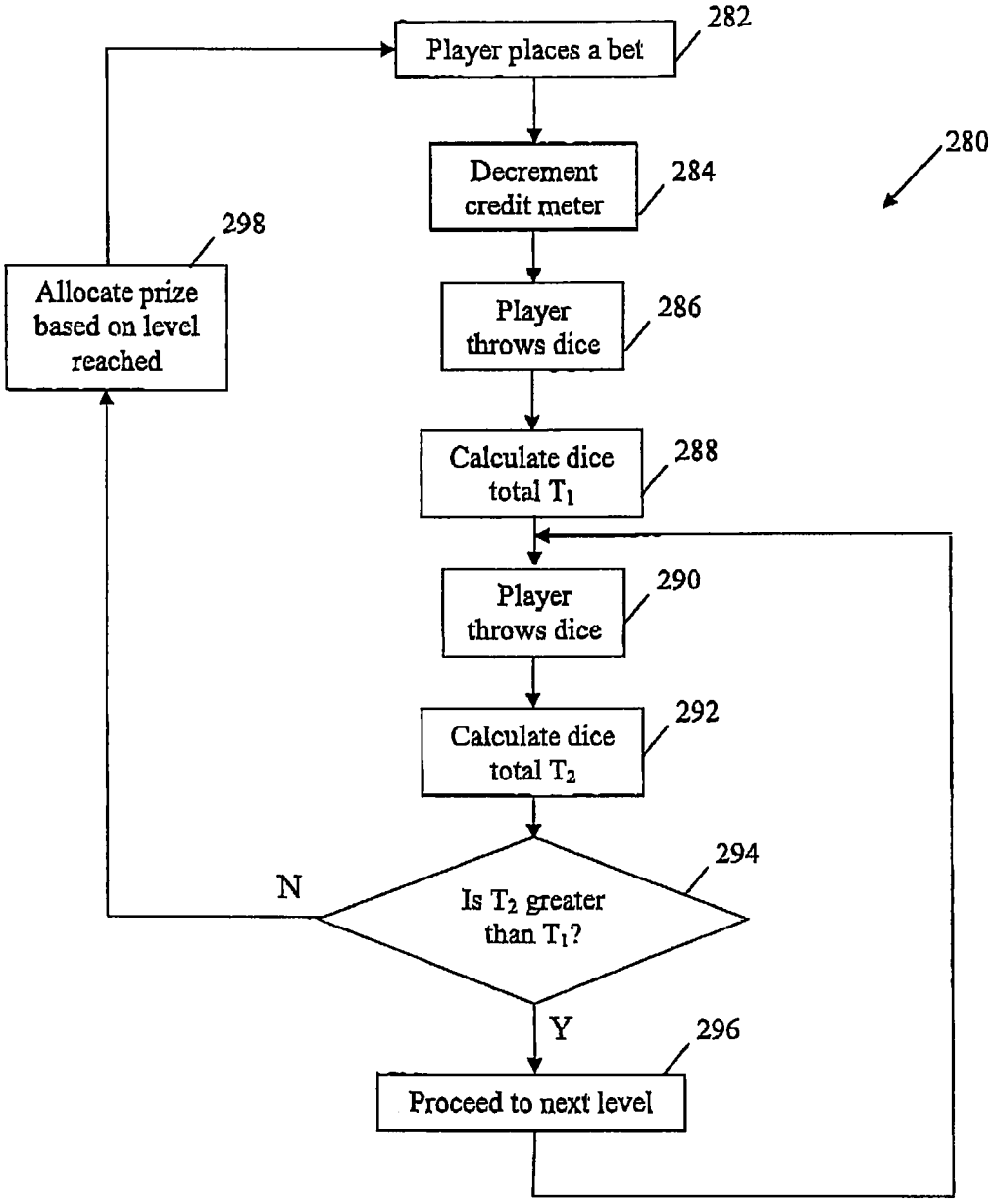
FIG. 8 is a flow diagram illustrating a method of gaming in accordance with an alternative embodiment of the present invention.

Referring to FIG. 8, there is shown a flow diagram 280 which illustrates steps 282 to 298 of an alternative method of gaming implemented by the gaming system 10.

In this example, the player is allocated 3 dice for use during the game and the player can bet 1 or more credits on the outcome of the game with an increase of the bet placed having the effect of multiplying the possible prize amount allocatable for each level of the game.

With this example, the gaming system implements a game wherein a player advances to a succeeding level of the game if the sum of the numbers shown on a players dice throw is greater than the sum of the numbers shown on a player's previous dice throw.

In one particular example, the symbols on each of the dice are 1, 2, 3, 4, 5 and 6, and 2 dice are allocated to the player.

Figure 9:
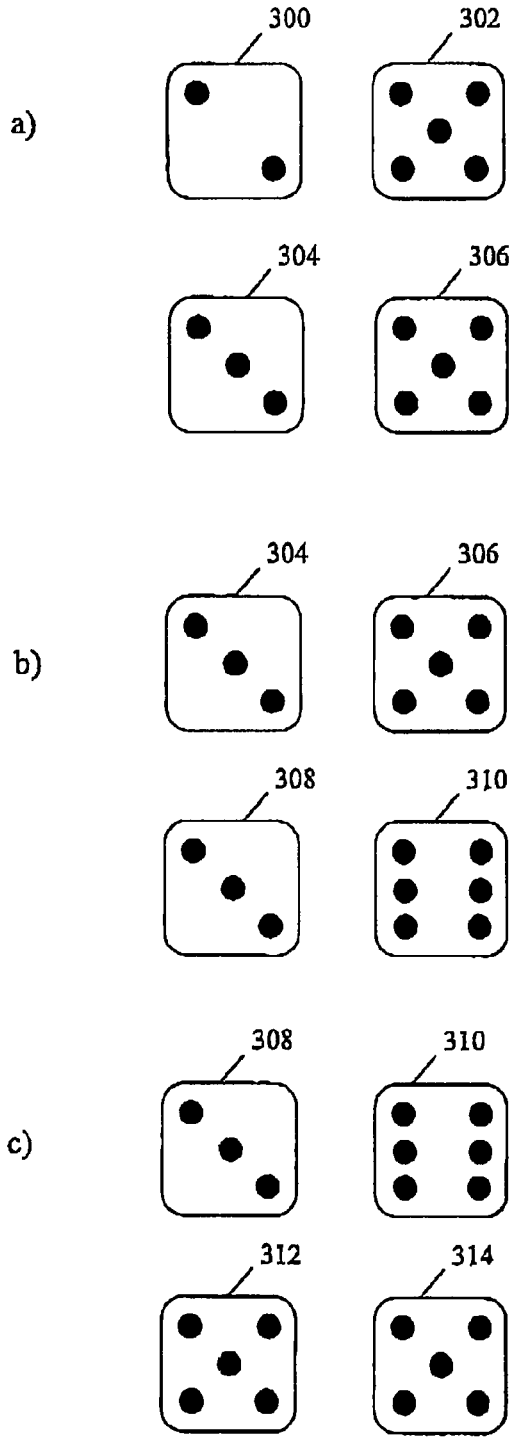
FIGS. 9*a* to 9*c* are diagrammatic representations of example symbols displayed by a gaming system in accordance with an embodiment of the present invention when implementing the method of gaming illustrated in FIG. 8.

The symbol selector 22 first selects 2 first numbers for 2 respective first player dice 300, 302, then selects 2 second numbers for 2 respective second player dice 304, 306, as shown in FIG. 9*a*. The first player dice 300, 302 are used in the first level of the game as reference dice.

The comparator 30 compares the sum $T_1$ of the numbers on the reference dice 300, 302 with the sum $T_2$ of the numbers on the second player dice 304, 306 and if $T_2$ is greater than or equal to $T_1$ the player proceeds to the next level. If $T_2$ is less than $T_1$, the multilevel game ceases and the outcome generator 32, in association with the prize allocator 34 and the prize data 18, then allocates an appropriate prize to the player dependent on the amount bet and the prize amount associated with the first level.

In the present example, the sum of the numbers on the reference dice 300, 302 is 7 and the sum of the numbers on the second dice 304, 306 is 8. Accordingly, the player is able to proceed to the second level.

At the second level, the second dice 304, 306 are retained and used in the second level of the game as reference dice, and the symbol selector 22 selects 2 third numbers for 2 respective third player dice 308, 310 as shown in FIG. 9*b*.

The comparator 30 then compares the reference sum $T_1$ of the numbers on the reference dice 304, 306 with the sum $T_2$ of the numbers on the third player dice 308, 310 and if $T_2$ is greater than or equal to $T_1$ the player proceeds to the third level. If $T_2$ is less than $T_1$, the multilevel game ceases and the outcome generator 32, in association with the prize allocator 34 and the prize data 18, then allocates an appropriate prize to the player dependent on the amount bet and the prize amount associated with reaching the second level.

In the present example, the sum of the numbers on the reference dice 304, 306 in 8 and the sum of the numbers on the third dice is 9 308, 310. Accordingly, the player is able to proceed to the third level.

At the third level, the third dice 308, 310 are retained and used in the third level of the game as reference dice, and the symbol selector 22 selects 2 forth numbers for 2 respective forth player dice 312, 314 as shown in FIG. 9*c*.

The comparator 30 then compares the reference sum $T_1$ of the numbers on the reference dice 308, 310 with the sum $T_2$ of the numbers on the forth player dice 312, 314. If $T_2$ is greater than or equal to $T_1$, the player is deemed successful at the third level.

In the present example, the sum of the numbers on the reference dice is 9 and the sum of the numbers on the third dice is 10. Accordingly, the player is successful at the third level.

The outcome generator 32, in association with the prize allocator 34 and the prize data 18 then allocates an appropriate prize to the player dependent on the amount bet and the prize amount associated with success at the third level.

While the present embodiment is described in relation to a game wherein a player proceeds to a succeeding level if the sum of numbers on the players dice is greater than or equal to the sum of numbers on reference dice, it will be understood that other arrangements are envisaged. For example, the game may be implemented such that a player proceeds to a succeeding level if the sum of numbers on the players dice is equal to, greater than, or less than the sum of numbers on the reference dice.

The present examples are described in relation to a multilevel game played by one player. However, it will be understood that other arrangements are envisaged such as a game played by multiple players, with for example the symbols on each player dice being compared with the symbols on a single set of reference dice, or compared with each other and relative rankings between players determined so as to determine which players are eligible to advance to the next level.

For example, in one variation several players are playing reel type gaming machines and during game play a special feature is triggered for at least some of the players which renders the players eligible to enter a special tournament game. In order to enable all players to view symbols generated during the tournament game, an overhead display may be provided.

The gaming machine associated with each player selects one die symbol and the selected die symbols are shown on the overhead display. The symbols on the dice are compared and ranked in accordance with predetermined rules, such as from highest number to lowest number, and the top 3 ranked dice are retained. The other dice are discarded and the players associated with the discarded dice may receive a prize.

The gaming machines associated with the remaining 3 players then select one die symbol and the selected die symbols are shown on the overhead display. The symbols on the dice are compared and ranked in accordance with predetermined rules, such as from highest number to lowest number, and the top 2 ranked dice are retained. The other die is discarded and the player associated with the discarded dice receives a prize.

The gaming machines associated with the remaining 2 players then select one die symbol and the die symbol is shown on the overhead display. The symbols on the dice are compared and ranked in accordance with predetermined rules, such as from highest number to lowest number, and the top ranked dice is awarded a special prize. The other die is discarded and the player associated with the discarded dice receives a prize.

The remaining player in the tournament game may be offered further opportunities to receive additional prizes, for example by throwing a die and comparing the number on the die with a prize schedule.

It will be appreciated that the above described specific examples both operate such that the game implemented by the gaming system tends to have a success probability which decreases with each succeeding level. In this way, as the game progresses, the player becomes less likely to succeed in reaching a higher level.

Modifications and variations as would be apparent to a skilled addressee are deemed to be within the scope of the present invention.

The invention claimed is:

1. A gaming system comprising:

a symbol selector configured to a) receive a first selection of a plurality of player symbols at each level of a multilevel game from a set of symbols, and b) receive a second selection of a plurality of game symbols from said set of symbols, each of said symbols having a value;

an outcome generator, at each level of the multilevel game, configured to a) determine a first sum of the values of the player symbols, b) determine a second sum of the values of the game symbols, c) compare the first sum to the second sum, d) determine a successful or unsuccessful game level outcome based on said comparison, and e) proceed to a succeeding game level in response to determining that said outcome being a successful game level outcome in which the first sum is greater than or equal to the second sum; and a prize allocator configured to allocate a prize based on the game level successfully completed and not based on the player symbols.

2. A gaming system as claimed in claim 1, and wherein at least one of the game symbols are selected by the symbol selector in a previous level of the multilevel game.

3. A gaming system as claimed in claim 1, and further comprising a user-interface configured to prompt a player to determine said first selection.

4. A gaming system as claimed in claim 1, and wherein the gaming system is configured such that the probability of proceeding to a successive level reduces with each successive level of the game.

5. A gaming system as claimed in claim 1, and wherein the symbol selector is configured to keep a number of the player symbols at a succeeding game level.

6. A gaming system as claimed in claim 1, and wherein the set of symbols is fixed for all levels of the multilevel game.

7. A gaming system as claimed in claim 1, and wherein the set of symbols from which the player symbols and the game symbols are selected is dependent on the game level.

8. A gaming system as claimed in claim 1, and wherein the number of selected game symbols is fixed for all levels of the multilevel game.

9. A gaming system as claimed in claim 1, and wherein the number of selected game symbols increases or decreases with each succeeding level of the multilevel game.

10. A gaming system as claimed in claim 1, and wherein the prize allocator is further configured to additionally allocate a prize based on an occurrence of a predetermined combination of player symbols at a level.

11. A gaming system as claimed in claim 1, wherein the prize allocator is further configured to additionally allocate a prize based on an occurrence of a predetermined sequence of symbol combinations in consecutive levels of the multilevel game.

12. A gaming system as claimed in claim 1, wherein the symbols comprise representations of dice, cards, dominos, tiles or shapes.

13. A method of gaming for use with a gaming machine having a symbol selector, a comparator, an outcome generator and a prize allocator, the method comprising:

selecting via the symbol selector a) a plurality of player symbols at each level of a multilevel game from a set of symbols, and b) a plurality of game symbols from said set of symbols, each of said symbols having a value;

determining via the outcome generator a first sum of the values of the player symbols and a second sum of the values of the game symbols comparing via the outcome generator the first sum to the second sum;

determining via the outcome generator a successful game level outcome in which the first sum is greater than or equal to the second sum;

proceeding via the outcome generator to a succeeding game level in response to determining that said outcome being a successful game level outcome allocating via the prize allocator a prize based on the game level reached and not based on the player symbols selected.

14. A method as claimed in claim 13, and further comprising designating at least one of the player symbols in a previous level of the multilevel game as one of the game symbols.

15. A method as claimed in claim 13, and further comprising reducing the probability of proceeding to a successive level with each successive level of the game.

16. A method as claimed in claim 13, and further comprising keeping a number of the player symbols at a succeeding game level.

17. A method as claimed in claim 13, and wherein the set of symbols is fixed for all levels of the multilevel game.

18. A method as claimed in claim 13, and wherein the set of symbols from which the player symbols and the game symbols are selected is dependent on the game level.

19. A method as claimed in claim 13, wherein the number of selected game symbols increases or decreases with each succeeding level of the multilevel game.

20. A method as claimed in claim 13, and further comprising additionally allocating a prize to a player based on an occurrence of a predetermined combination of player symbols at a level.

* * * * *